US011725864B2

(12) United States Patent
Kan et al.

(10) Patent No.: US 11,725,864 B2
(45) Date of Patent: Aug. 15, 2023

(54) REFRIGERATOR

(71) Applicant: Samsung Electronics Co., Ltd., Suwon-si (KR)

(72) Inventors: Kentaro Kan, Yokohama (JP); Hiroshi Nakamura, Yokohama (JP); Makoto Shibuya, Yokohama (JP); Manabu Kikuchi, Yokohama (JP); Ryota Aoki, Yokohama (JP); Tomohiko Matsuno, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 88 days.

(21) Appl. No.: 17/385,336

(22) Filed: Jul. 26, 2021

(65) Prior Publication Data

US 2022/0049891 A1 Feb. 17, 2022

(30) Foreign Application Priority Data

Aug. 13, 2020 (JP) ..... 2020-136616
May 4, 2021 (KR) ..... 10-2021-0057605

(51) Int. Cl.
*F25D 17/04* (2006.01)
*F25D 17/06* (2006.01)

(52) U.S. Cl.
CPC ..... *F25D 17/045* (2013.01); *F25D 17/065* (2013.01)

(58) Field of Classification Search
CPC .... F25D 17/045; F25D 17/065; F25D 23/085; F25D 2317/067; F25D 2400/16
See application file for complete search history.

(56) References Cited

U.S. PATENT DOCUMENTS 8,038,235 B2 * 10/2011 Lowery ..... F25D 23/12 312/401
8,266,923 B2 * 9/2012 Bauer ..... F25D 19/00 62/448
9,182,158 B2 * 11/2015 Wu ..... F25B 5/02
2004/0035142 A1 2/2004 Yoon et al.
2004/0118141 A1 * 6/2004 Kim ..... F25D 11/00 62/258

(Continued)

FOREIGN PATENT DOCUMENTS

EP 0 334 414 A2 9/1989
JP 2575519 B2 1/1997

(Continued)

OTHER PUBLICATIONS

International Search Report dated Nov. 8, 2021, issued in International Patent Application No. PCT/KR2021/009632.

*Primary Examiner* — Filip Zec
(74) *Attorney, Agent, or Firm* — Jefferson IP Law, LLP

(57) ABSTRACT

A refrigerator is provided. The refrigerator includes a main cabinet including a cooling device to generate cold air, a sub-cabinet detachably connected to the main cabinet, a cold air relay duct provided to connect the main cabinet and the sub-cabinet and having a cold air flow path to allow the cold air generated by the cooling device to be delivered to the sub-cabinet, and a heat blocking member provided in a portion of the cold air flow path at which the main cabinet and the cold air relay duct are connected and in a portion of the cold air flow path at which the sub-cabinet and the cold air relay duct are connected.

16 Claims, 7 Drawing Sheets

(56) References Cited

U.S. PATENT DOCUMENTS

| | | | | |
|---|---|---|---|---|
| 2007/0245767 | A1* | 10/2007 | Hara | F16K 11/052 62/448 |
| 2008/0156030 | A1* | 7/2008 | Cur | F25D 11/027 62/441 |
| 2018/0209713 | A1* | 7/2018 | Yun | F25D 25/005 |
| 2019/0226749 | A1 | 7/2019 | Lee | |
| 2020/0072525 | A1 | 3/2020 | Makoto et al. | |

FOREIGN PATENT DOCUMENTS

| | | | |
|---|---|---|---|
| JP | 1068573 | A | 3/1998 |
| JP | 3553778 | B2 | 8/2004 |
| KR | 20-1999-0030012 | U | 7/1999 |
| KR | 10-0452983 | B1 | 10/2004 |

* cited by examiner

REFRIGERATOR

CROSS-REFERENCE TO RELATED APPLICATION(S)

This application is based on and claims priority under 35 U.S.C. § 119(a) of a Japanese patent application number 2020-136616, filed on Aug. 13, 2020, in the Japanese Intellectual Property Office, and of a Korean patent application number 10-2021-0057605, filed on May 4, 2021, in the Korean Intellectual Property Office, the disclosure of each of which is incorporated by reference herein in its entirety.

BACKGROUND

1. Field

The disclosure relates to a refrigerator.

2. Description of Related Art

Among refrigerators of the related art, as disclosed in Patent Document 1, there is a refrigerator in which a plurality of cabinets is detachably configured. This configuration allows a user to freely customize the arrangement of the cabinets or internal capacity without having to change the refrigerator depending on changes in lifestyle, such as childbirth, independence, and living with parents.

In such a refrigerator, providing a cooling device in each cabinet reduces a storage capacity and greatly increases a cost. Therefore, in order to suppress a decrease in the storage capacity, for example, a configuration is being developed in which a cooling device is provided in one main cabinet, and the main cabinet and other sub-cabinet are connected through a cold air relay duct. In this configuration, because cold air may be delivered from the main cabinet to the sub-cabinet through the cold air relay duct, there is no need to provide a cooling device in each cabinet.

However, because a cold air blowing surface inside the cold air relay duct becomes very cold (e.g. −25 degrees Celsius) when cold air is delivered through the cold air relay duct in this way, as this cold air is delivered to the cold air relay duct and the cabinet surface, a dew condensation may occur (refer to Japanese Patent Laid-Open No. 10-68573).

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a refrigerator capable of suppressing the occurrence of dew condensation while delivering cold air from a main cabinet to a sub-cabinet through a cold air relay duct in the refrigerator in which a plurality of cabinets are detachably configured.

Additional aspects will be set forth in part in the description which follows and, in part, will be apparent from the description, or may be learned by practice of the presented embodiments.

In accordance with an aspect of the disclosure, a refrigerator is provided. The refrigerator includes a main cabinet including a cooling device to generate cold air, a sub-cabinet detachably connected to the main cabinet, a cold air relay duct having a cold air flow path that connects the main cabinet to the sub-cabinet to allow the cold air generated by the cooling device to be delivered to the sub-cabinet, and a heat blocking member provided in a portion of the cold air flow path at which the main cabinet and the cold air relay duct are connected and in a portion of the cold air flow path at which the sub-cabinet and the cold air relay duct are connected.

The cold air flow path may include a main flow path formed in the main cabinet, a sub flow path formed in the sub-cabinet, and a relay flow path formed in the cold air relay duct to connect the main flow path and the sub flow path.

The heat blocking member may be provided at a connection portion between the main flow path and the relay flow path and at a connection portion between the sub flow path and the relay flow path.

The main cabinet may include a first facing surface facing the cold air relay duct, the sub-cabinet may include a second facing surface facing the cold air relay duct, and the cold air relay duct may include a third facing surface facing the main cabinet and a fourth facing surface facing the sub-cabinet.

The heat blocking member may include a first heat blocking member provided between the main flow path and the first facing surface, a second heat blocking member provided between the sub flow path and the second facing surface, a third heat blocking member provided between the relay flow path and the third facing surface, and a fourth heat blocking member provided between the relay flow path and the fourth facing surface.

The first heat blocking member and the third heat blocking member may include a first passing hole and a third passing hole to connect the main flow path and the relay flow path, respectively.

At least one of the first passing hole and the third passing hole may be formed in a tapered shape in which a width at the ends connected to each other gradually increases.

The second heat blocking member and the fourth heat blocking member may include a second passing hole and a fourth passing hole to connect the sub flow path and the relay flow path, respectively.

At least one of the second passing hole and the fourth passing hole may be formed in a tapered shape in which a width at the ends connected to each other gradually increases.

The cold air flow path may be formed by an inner space of a cylindrical member made of a resin material, and the cylindrical member may include a first cylindrical member forming the main flow path, a second cylindrical member forming the sub flow path, and a third cylindrical member forming the relay flow path.

The heat blocking member may have a lower thermal conductivity than the cylindrical member.

The second facing surface of the sub-cabinet and the fourth facing surface of the cold air relay duct facing the second facing surface may have an inclined surface inclined with respect to a horizontal direction.

The cold air relay duct may include a protrusion formed on the third facing surface to protrude downward, and the main cabinet may include a recess portion formed on the first facing surface to allow the protrusion to be inserted.

The first facing surface of the main cabinet and the third facing surface of the cold air relay duct facing the first facing surface may have a first inclined surface inclined with respect to a horizontal direction, and the second facing surface of the sub-cabinet and the fourth facing surface of the cold air relay duct facing the second facing surface may have a second inclined surface inclined with respect to the horizontal direction.

A first seal member may be provided between the first facing surface of the main cabinet and the third facing surface of the cold air relay duct, and a second sealing member may be provided between the second facing surface of the sub-cabinet and the fourth facing surface of the cold air relay duct.

The inclined surface may be provided to have an angle between 25 and 65 degrees with respect to the horizontal direction.

The cold air relay duct may connect the main cabinet and the sub-cabinet such that at least a portion of a surface thereof is exposed to the outside.

In accordance with another aspect of the disclosure, a refrigerator is provided. The refrigerator includes a main cabinet including a cooling device to generate cold air, a sub-cabinet detachably connected to the main cabinet, a cold air relay duct connecting the main cabinet and the sub-cabinet such that the cold air generated by the cooling device is delivered to the sub-cabinet, a cold air flow path formed of a cylindrical member and including a main flow path formed in the main cabinet, a sub flow path formed in the sub-cabinet, and a relay flow path formed in the cold air relay duct to connect the main flow path and the sub flow path, and a heat blocking member provided at a portion where the main flow path and the relay flow path are connected and a portion where the sub flow path and the relay flow path are connected and having a lower thermal conductivity than the cylindrical member.

The main cabinet may include a first facing surface facing the cold air relay duct, the sub-cabinet may include a second facing surface facing the cold air relay duct, and the cold air relay duct may include a third facing surface facing the main cabinet and a fourth facing surface facing the sub-cabinet.

The second facing surface of the sub-cabinet and the fourth facing surface of the cold air relay duct facing the second facing surface may have an inclined surface inclined with respect to a horizontal direction.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

The same reference numerals are used to represent the same elements throughout the drawings.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Also, the terms "comprises" and "has" are intended to indicate that there are features, numbers, operations, elements, parts, or combinations thereof described in the specification, and do not exclude the presence or addition of one or more other features, numbers, operations, elements, parts, or combinations thereof.

It will be understood that although the terms first, second, etc. may be used herein to describe various components, these components should not be limited by these terms, and the terms are only used to distinguish one component from another. For example, without departing from the scope of the disclosure, the first component may be referred to as a second component, and similarly, the second component may also be referred to as a first component. The term "and/or" includes any combination of a plurality of related items or any one of a plurality of related items.

The terms "front end," "rear end," "upper portion," "lower portion," "upper end" and "lower end" used in the following description are defined with reference to the drawings, and the shape and position of each component are not limited by these terms.

Figure 1:
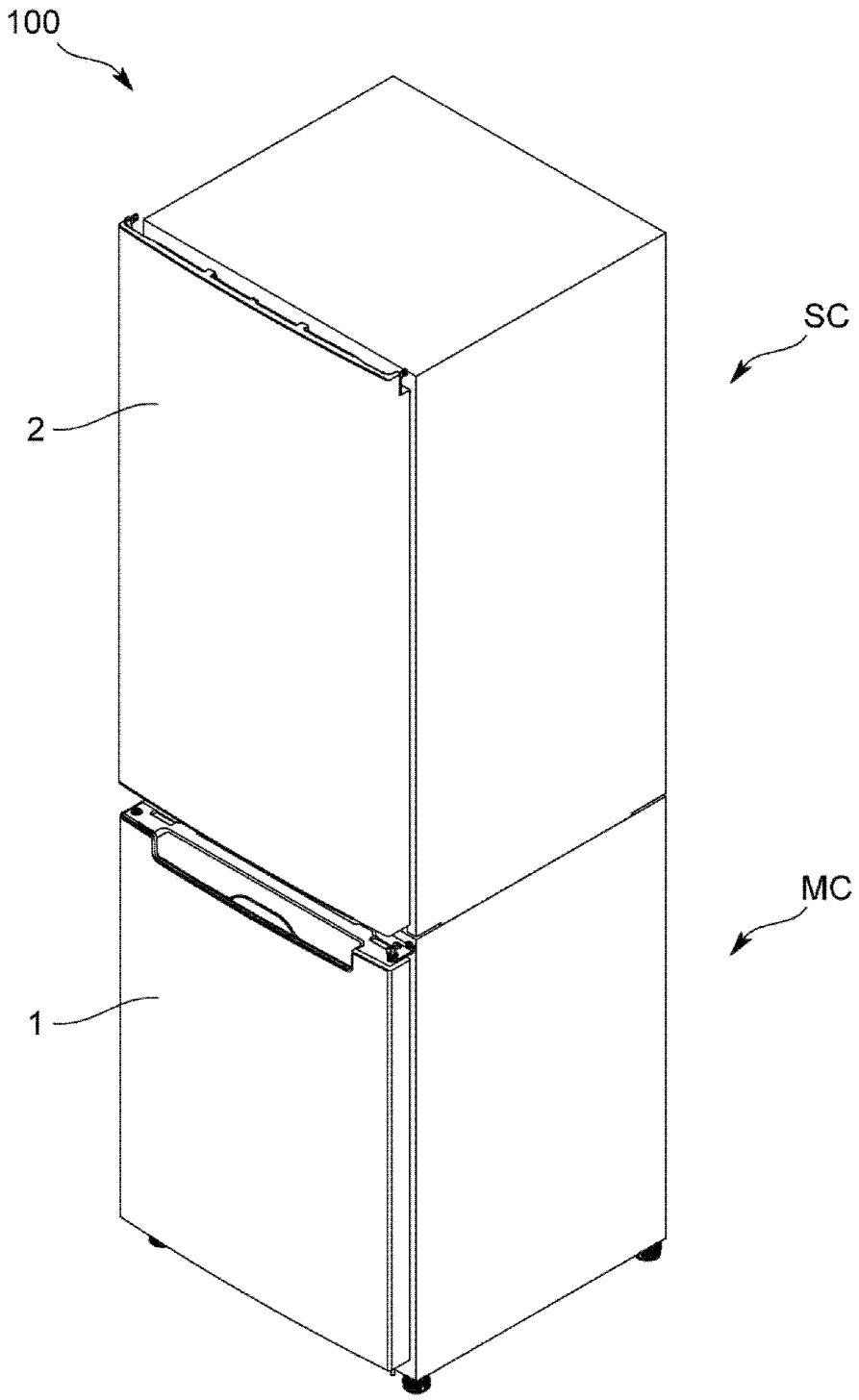
FIG. 1 is a perspective view illustrating an overall configuration of a refrigerator according to an embodiment of the disclosure.

FIG. 1 is a perspective view illustrating the overall configuration of a refrigerator according to an embodiment of the disclosure.

Referring to FIG. 1, a refrigerator 100 according to the embodiment is manufactured by assembling a plurality of cabinets MC and SC, and the cabinets MC and SC are configured to be detachable from each other.

Figure 2:
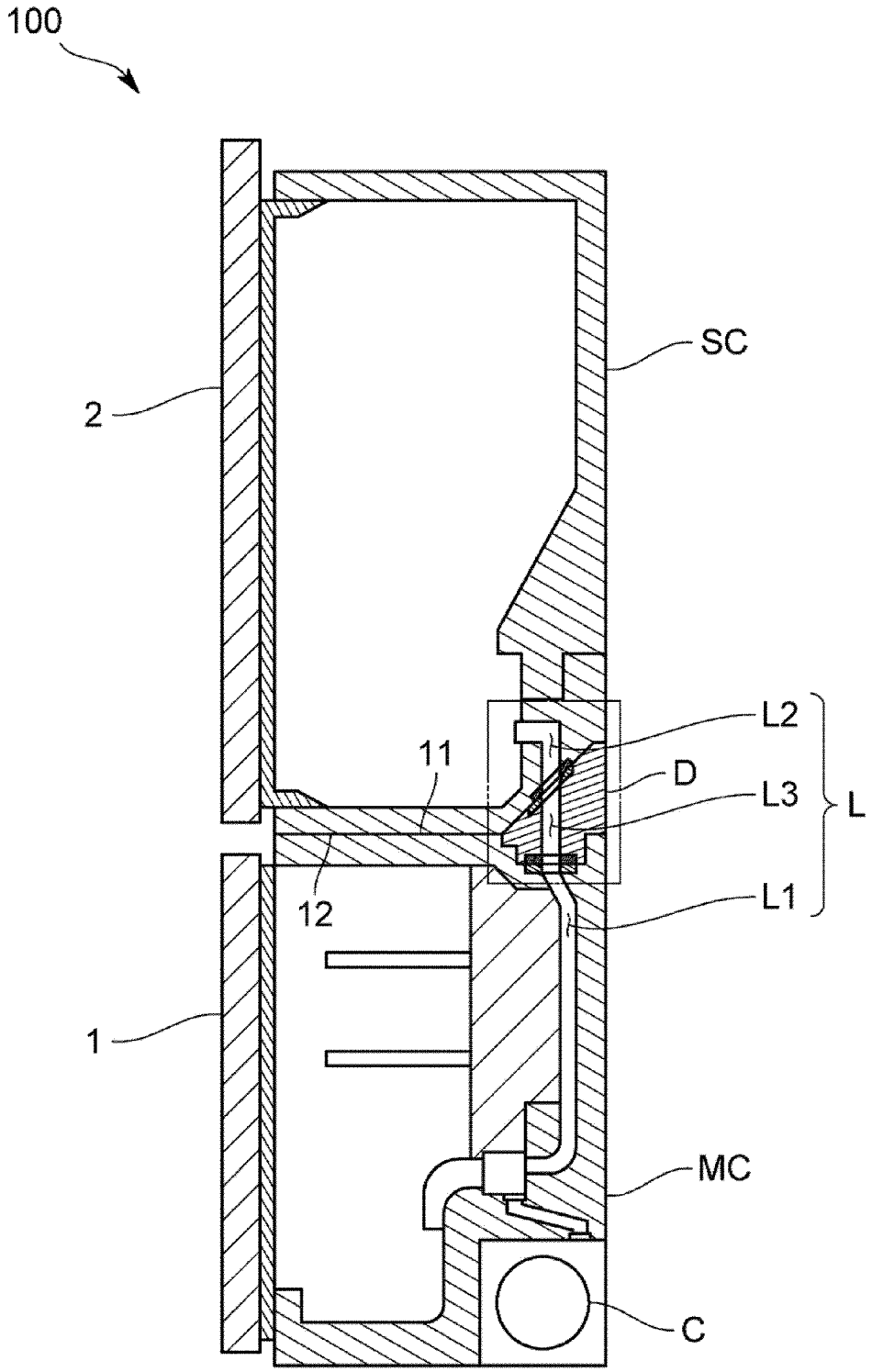
FIG. 2 is a cross-sectional view illustrating an internal configuration of a refrigerator according to an embodiment of the disclosure.

FIG. 2 is a cross-sectional view illustrating an internal configuration of the refrigerator according to an embodiment of the disclosure.

Specifically, referring to FIG. 2, the refrigerator 100 includes the main cabinet MC, the sub-cabinet SC detachable with respect to the main cabinet MC, and a cold air relay duct D to connect the main cabinet MC and the sub-cabinet SC.

Hereinafter, a case in which one of the sub-cabinet SC is installed on the main cabinet MC will be described, but a plurality of the sub-cabinets SC may be installed on the main cabinet MC, or another sub-cabinet may be installed on the sub-cabinet SC which is installed on the main cabinet MC.

Referring to FIGS. 1 and 2, the main cabinet MC has a cuboid or a regular hexahedron shape with a door 1 provided on the front, and includes a cooling device C or a compressor constituting a refrigerant circuit.

Referring to FIGS. 1 and 2, the sub-cabinet SC has a cuboid shape or a regular hexahedron shape with a door 2 provided on the front, and has a different configuration from the main cabinet MC in that the sub-cabinets SC does not include the cooling device C or the compressor constituting the refrigerant circuit. The sub-cabinet SC of the embodiment is detachably installed on an upper surface 11 of the main cabinet MC, but may be detachably installed on a lower surface or side surface of the main cabinet MC.

The cold air relay duct D is provided between the main cabinet MC and sub-cabinet SC to connect the main cabinet MC and sub-cabinet SC, and cold air generated by the cooling device C described above flows from the main cabinet MC to the sub-cabinet SC through the cold air relay duct D. The cold air relay duct D is interposed between facing joint surfaces 11 and 12 of the main cabinet MC and the sub-cabinet SC, and in the embodiment, the cold air relay duct D is provided between the upper surface 11, which is the facing joint surface 11 of the main cabinet MC, and the lower surface 12, which is the facing joint surface 12 of the sub-cabinet SC.

As such, by connecting the main cabinet MC and the sub-cabinet SC through the cold air relay duct D, referring to FIG. 2, a cold air flow path in which cold air reaches the sub-cabinet SC from the main cabinet MC through the cold air relay duct D is formed.

Hereinafter, a structure around the cold air flow path L will be described in more detail.

Figure 3:
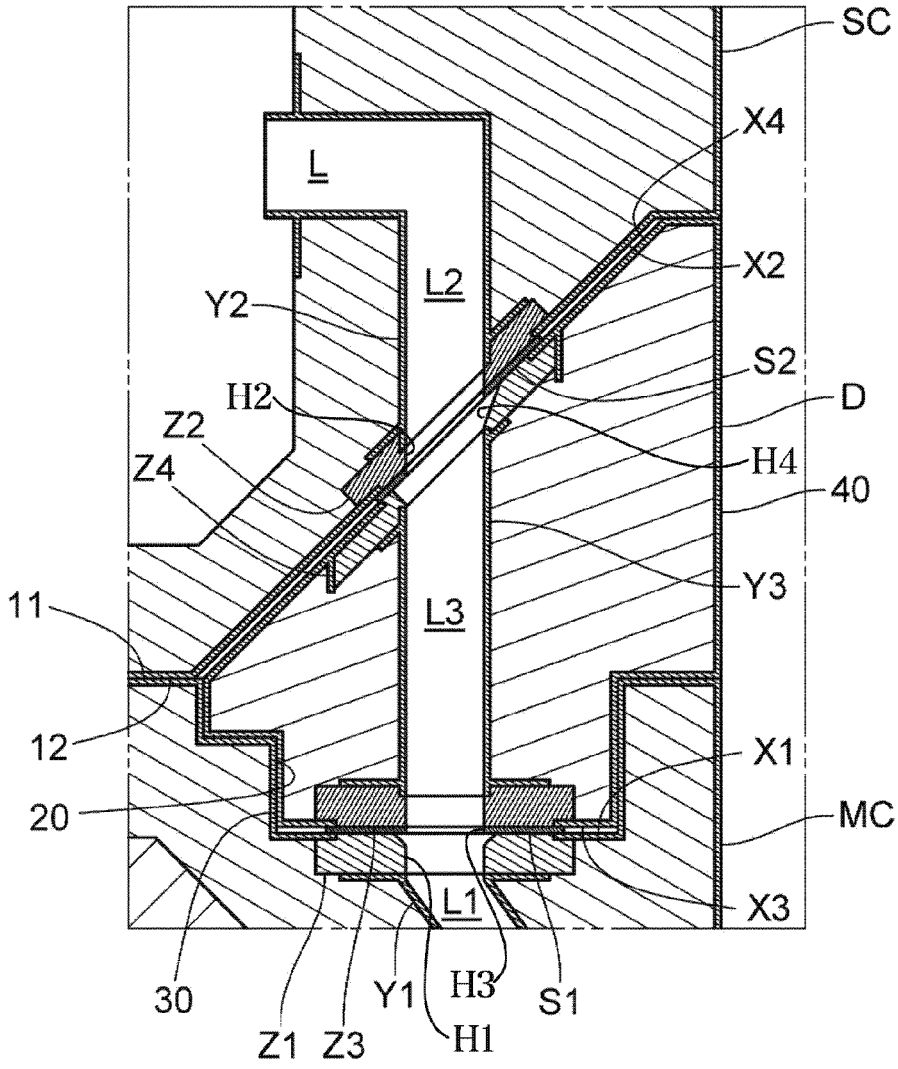
FIG. 3 is a cross-sectional view illustrating a surrounding configuration of a cold air relay duct of a refrigerator according to an embodiment of the disclosure.

FIG. 3 is a cross-sectional view illustrating a surrounding configuration of a cold air relay duct of the refrigerator according to an embodiment of the disclosure.

Referring to FIG. 3, the main cabinet MC has a main flow path L1 that is open at a first facing surface X1 facing the cold air relay duct D and forms the main cabinet MC side of the cold air flow path L. The main flow path L1, which is an internal space of a first cylindrical member Y1 made of resin such as Acrylonitrile Butadiene Styrene (ABS), guides the cold air generated by the cooling device C to the cold air relay duct D. The main cabinet MC of the embodiment may include a recess portion 20 formed by recessing a portion of the facing joint surface (upper surface) 11. One end of the cold air relay duct D is inserted into the recess portion 20. That is, a bottom surface of the recess portion 20 is formed as the first facing surface X1 described above.

Referring to FIG. 3, the sub-cabinet SC has a sub flow path L2 that is open at a second facing surface X2 facing the cold air relay duct D and forms the sub-cabinet SC side of the cold air flow path L. The sub flow path L2, which is an internal space of a second cylindrical member Y2 made of resin such as ABS, guides the cold air introduced from the cold air relay duct D to the inside of an main body of the sub-cabinet SC by allowing the cold air relay duct D and the inside of the main body of the sub-cabinet SC to communicate with each other. A portion of the facing joint surface (lower surface) 12 of the sub-cabinet SC of the embodiment is formed to be inclined, and this inclined portion forms the second facing surface X2. Herein, the inclination is a concept including a vertical direction. A facing surface X4 of the cold air relay duct D facing the sub-cabinet SC, which will be described later in detail, also forms an inclined surface, and through this, for example, by approaching the sub-cabinet SC to the cold air relay duct D from the front, both the facing surfaces X2 and X4 overlap each other. Herein, inclination angles of the facing surfaces X2 and X4 with respect to a horizontal direction are, for example, 25 degrees or more and 65 degrees or less.

Referring to in FIG. 3, the cold air relay duct D has a relay flow path L3 that is open at a third facing surface X3 facing the main cabinet MC and open at the fourth facing surface X4 facing the sub-cabinet SC. The relay flow path L3, which is an internal space of a third cylindrical member Y3 made of resin such as ABS, guides the cold air introduced from the main flow path L1 to the sub flow path L2 by allowing the main flow path L1 and the sub flow path L2 to communicate with each other.

A surface of the cold air relay duct D of the embodiment is made of, for example, resin such as ABS, the third cylindrical member Y3 is disposed inside the cold air relay duct D, and a heat insulating material such as urethane foam is enclosed around the third cylindrical member Y3.

As an additional description of a specific configuration of the cold air relay duct D, a protrusion 30 is formed on a surface of the cold air relay duct D on the main cabinet MC side, and a front surface of protrusion 30 forms the third facing surface X3. A surface of the cold air relay duct D on the sub-cabinet SC side is inclined with respect to the horizontal direction, and this inclined surface forms the fourth facing surface X4. The cold air relay duct D is disposed such that at least a portion of the surface thereof is exposed, and specifically, a rear surface (i.e., back surface) 40 thereof constitutes a portion of a rear surface of the refrigerator 100.

Figure 4:
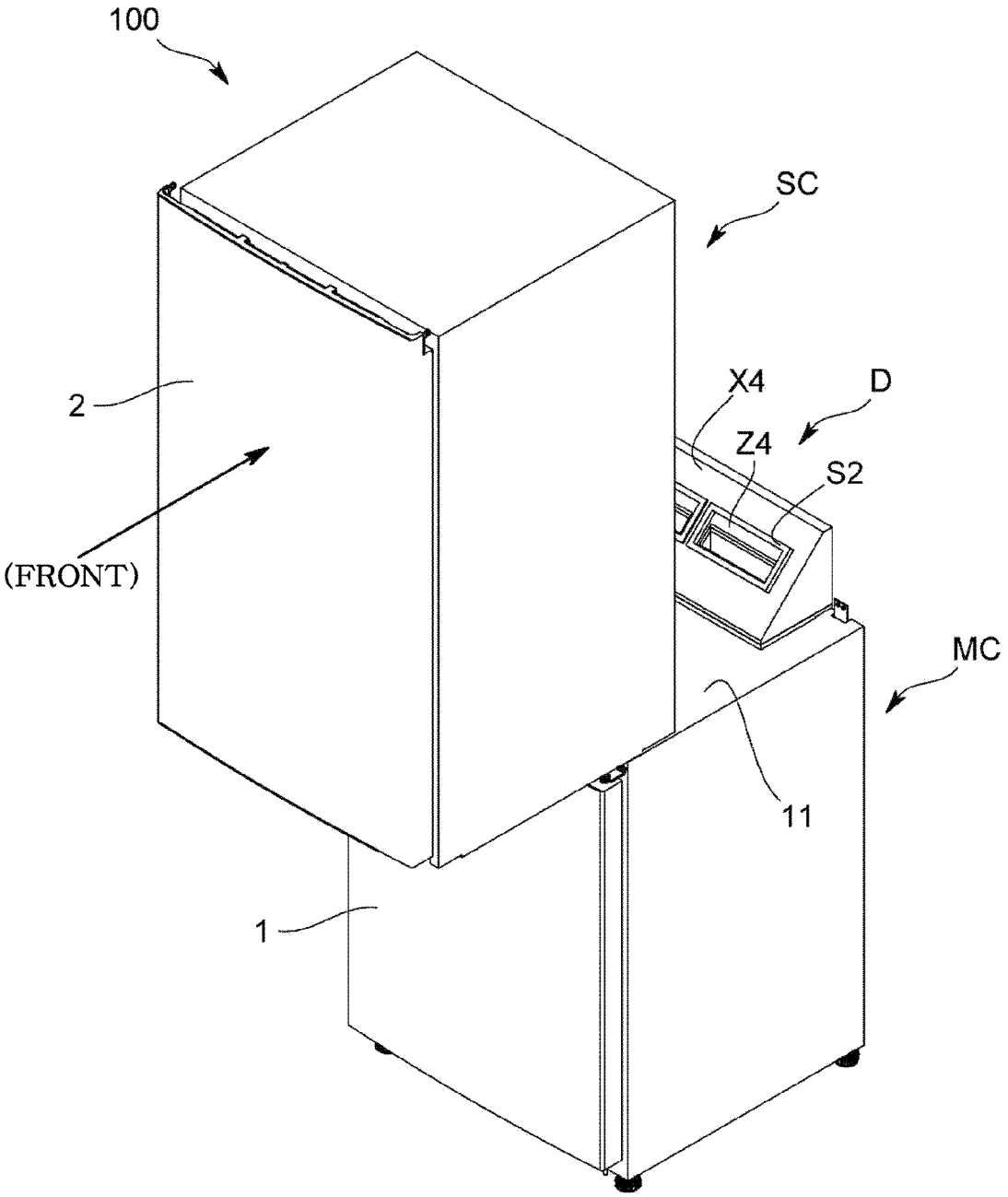
FIG. 4 is a perspective view illustrating an example of a method of assembling a refrigerator according to an embodiment of the disclosure.

FIG. 4 is a perspective view illustrating an example of a method of assembling the refrigerator according to an embodiment of the disclosure.

Referring to FIGS. 2, 3 and 4, in this configuration, when the sub-cabinet SC is installed on the main cabinet MC, for example, first, the protrusion 30 of the cold air relay duct D is inserted into the recess portion 20 of the main cabinet MC, and the first facing surface X1 and the third facing surface X3 are joined, so that the main flow path L1 and the relay flow path L3 communicate with each other. Next, as referring to FIG. 4, for example, the sub-cabinet SC approaches the cold air relay duct D from the front, and the second facing surface X2 and the fourth facing surface X4 are joined, so that the relay flow path L3 and the sub flow path L2 communicate with each other. As a result, the cold air flow path L is formed by the main flow path L1, the relay flow path L3, and the sub flow path L2.

When tolerances occur in connection portions of the main flow path L1, the relay flow path L3, and the sub flow path L2 due to assembly deviations of the main flow path L1, the relay flow path L3, and the sub flow path L2, cold air may leak or pressure loss may increase in the connection portions.

Therefore, in the embodiment, in order to reduce the tolerances caused by the assembly deviations, the assembly deviation may be absorbed by widening a flow path width of the connection portion with a flow path adjacent to at least one of the main flow path L1, the relay flow path L3, and the sub flow path L2.

More specifically, referring to FIG. 2, in the connection portion between the main flow path L1 and the relay flow path L3, an end of the main flow path L1 on the first facing surface X1 side is formed in a tapered shape in which the flow path width gradually increases toward the first facing surface X1.

Also, in the connection portion between the sub flow path L2 and the relay flow path L3, an end of the relay flow path L3 on the fourth facing surface X4 side is formed in a tapered shape in which the flow path width gradually increases toward the fourth facing surface X4.

In order to absorb the assembly deviation, the flow path does not necessarily have a tapered shape even when the flow path width is formed wide, and the flow path of the connection portion may have a suitable shape.

In order to ensure sealing performance (sealability) between the main cabinet MC and the cold air relay duct D, in the embodiment, a first seal member S1 may be provided between the facing surfaces of the main cabinet MC and the cold air relay duct D which face each other. Also, in order to ensure sealing performance between the sub-cabinet SC and the cold air relay duct D, a second seal member S2 may be provided between the facing surfaces of the sub-cabinet SC and the cold air relay duct D which face each other. Specifically, the first seal member S1 and the second seal member S2 are foams formed in an annular shape with a material, for example, such as rubber to surround the cold air flow path L.

Referring to FIG. 3, the refrigerator 100 of the embodiment includes a first heat blocking member Z1 provided between the first facing surface X1 of the main cabinet MC and the cold air flow path L, and a second heat blocking member Z2 provided between the second facing surface X2 of the sub-cabinet SC and the cold air flow path L.

The first heat blocking member Z1 and the second heat blocking member Z2 are provided to suppress the cold air flowing through the cold air flow path L from being delivered to a surface of the refrigerator 100, and at least have lower thermal conductivity than the cylindrical members Y1 and Y2 in which an inner space thereof forms the cold air flow path L. Specifically, the first heat blocking member Z1 has a lower thermal conductivity than a material (herein, resin such as ABS) forming the first cylindrical member Y1, and is made of, for example, a synthetic resin such as foamed styrene (Styrofoam). Also, the second heat blocking member Z2 has a lower thermal conductivity than a material (herein, resin such as ABS) forming the second cylindrical member Y2, and is made of, for example, a synthetic resin such as foamed styrene.

The first heat blocking member Z1 is interposed between the first facing surface X1 and the main flow path L1, and specifically is disposed in the first facing surface X1 and has a first passing hole H1 constituting an end of the main flow path L1.

The second heat blocking member Z2 is interposed between the second facing surface X2 and the sub flow path L2, and specifically is disposed in the second facing surface X2 and has a second passing hole H2 constituting an end of the sub-flow path L2.

Referring to FIG. 2, the refrigerator 100 of the embodiment further includes a third heat blocking member Z3 interposed between the third facing surface X3 of the cold air relay duct D and the cold air flow path L, and a fourth heat blocking member Z4 interposed between the fourth facing surface X4 of the cold air relay duct D and the cold air flow path L.

Like the first heat blocking member Z1 and the second heat blocking member Z2, the third heat blocking member Z3 and the fourth heat blocking member Z4 are provided to suppress the cold air flowing through the cold air flow path L from being delivered to the surface of the refrigerator 100, and have lower thermal conductivity than the cylindrical member Y in which the inner space thereof forms the cold air flow path L. Specifically, the third heat blocking member Z3 has a lower thermal conductivity than a material (herein, resin such as ABS) forming the third cylindrical member Y3, and is made of, for example, a synthetic resin such as foamed styrene. Also, the fourth heat blocking member Z4 has a lower thermal conductivity than a material (herein, resin such as ABS) forming the third cylindrical member Y3.

The third heat blocking member Z3 is interposed between the third facing surface X3 and the relay flow path L3, and specifically is disposed in the third facing surface X3 and has a third passing hole H3 constituting one end of the relay flow path L3.

The fourth heat blocking member Z4 is interposed between the fourth facing surface X4 and the relay flow path L3, and specifically is disposed in the fourth facing surface X4 and has a fourth passing hole H4 constituting the other end of the relay flow path L3.

As described above, the heat blocking members Z1 to Z4 are provided to suppress the transfer of cold air to the surface of the refrigerator 100, and function to block transfer paths of cold air from the cold air flow path L to the surface of the refrigerator 100. More specifically, the first heat blocking member Z1 discontinues an outer plate (specifically, the first facing surface X1) of the main cabinet MC and the cylindrical member Y forming the cold air flow path L to thermally block the outer plate of the main cabinet MC and the cylindrical member Y. The second heat blocking member Z2 discontinues an outer plate (specifically, the second facing surface X2) of the sub-cabinet SC and the cylindrical member Y forming the cold air flow path L to thermally block the outer plate of the sub-cabinet SC and the cylindrical member Y. The third heat blocking member Z3 discontinues an outer surface (specifically, the third facing surface X3) of the cold air relay duct D and the cylindrical member Y forming the cold air flow path L to thermally block the outer surface of the cold air relay duct D and the cylindrical member Y. The fourth heat blocking member Z4 discontinues the outer surface (specifically, the fourth facing surface X4) of the cold air relay duct D and the cylindrical member Y forming the cold air flow path L to thermally block the outer surface of the cold air relay duct D and the cylindrical member Y.

According to the refrigerator 100 configured as described above, because the first heat blocking member Z1 is interposed between the first facing surface X1 of the main cabinet MC and the main flow path L1, and at the same time the second heat blocking member Z2 is interposed between the second facing surface X2 of the sub-cabinet SC and the sub flow path L2, the transfer of cold air to the surface of the cold air relay duct D, the surface of the main cabinet MC, or the surface of the sub-cabinet SC may be suppressed.

Therefore, in the configuration in which the sub-cabinet SC is detachably installed on the main cabinet MC, the occurrence of dew condensation may be suppressed while cold air is delivered from the main cabinet MC to the sub-cabinet SC through the cold air relay duct D.

Further, because the third heat blocking member Z3 is interposed between the third facing surface X3 of the cold air relay duct D and the relay flow path L3, and at the same time the fourth heat blocking member Z4 is interposed between the fourth facing surface X4 of the cold air relay duct D and the relay flow path L3, the transfer of cold air to the surface (e.g., the rear surface 40) of the cold air relay duct D may be suppressed.

Further, because the inner space of the third cylindrical member Y3 made of a resin material is provided as the relay flow path L3, for example, foamed urethane may be filled and sealed inside the cold air relay duct D.

Further, because the second facing surface X2 and the fourth facing surface X4 of the sub-cabinet SC and the cold air relay duct D, which face each other, are formed as inclined surfaces inclined with respect to the horizontal direction, for example, the sub-cabinet SC may be assembled from the front after the cold air relay duct D is installed in the main cabinet MC, thereby enabling simple and convenient assembly.

The disclosure is not limited to the above embodiment.

Figure 5:
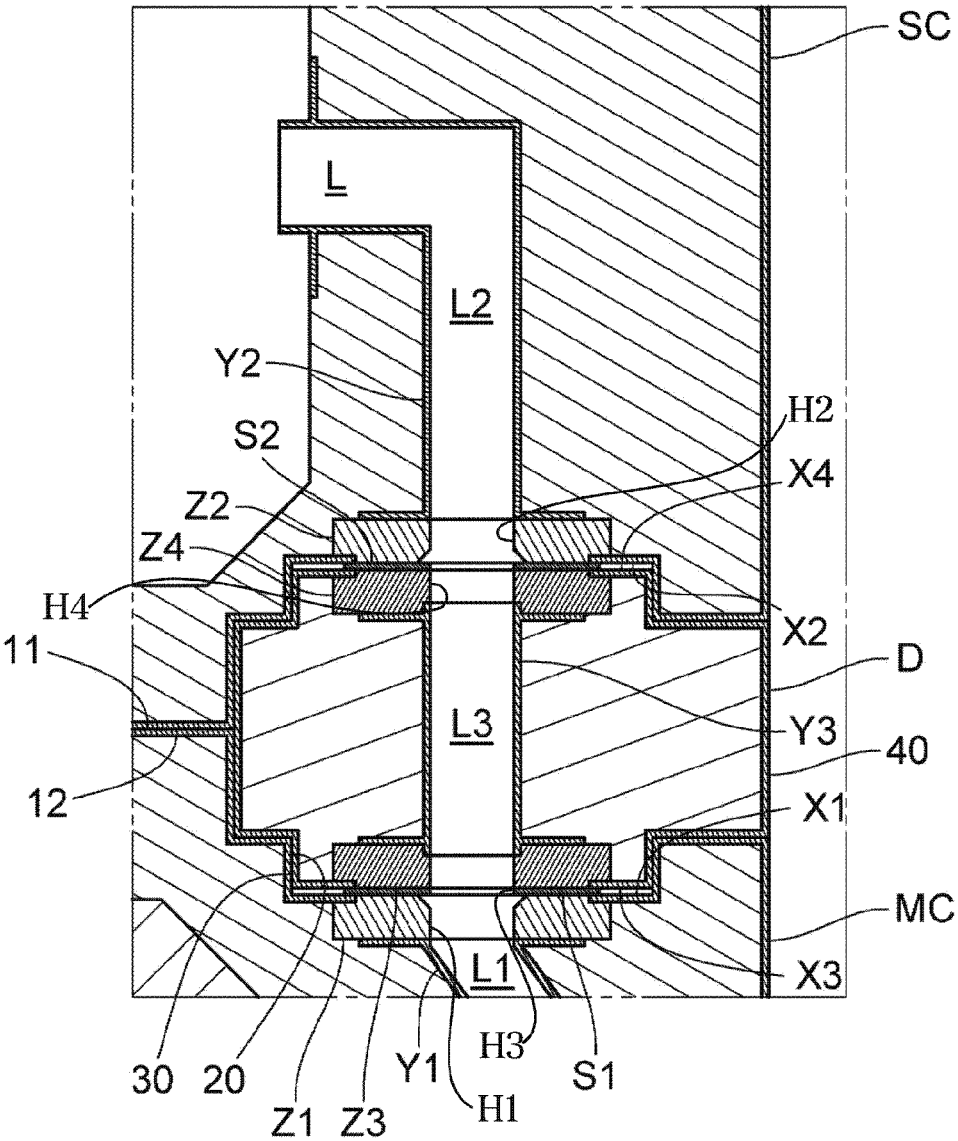
FIG. 5 is a cross-sectional view illustrating an internal configuration of a refrigerator according to an embodiment of the disclosure.
Figure 6:
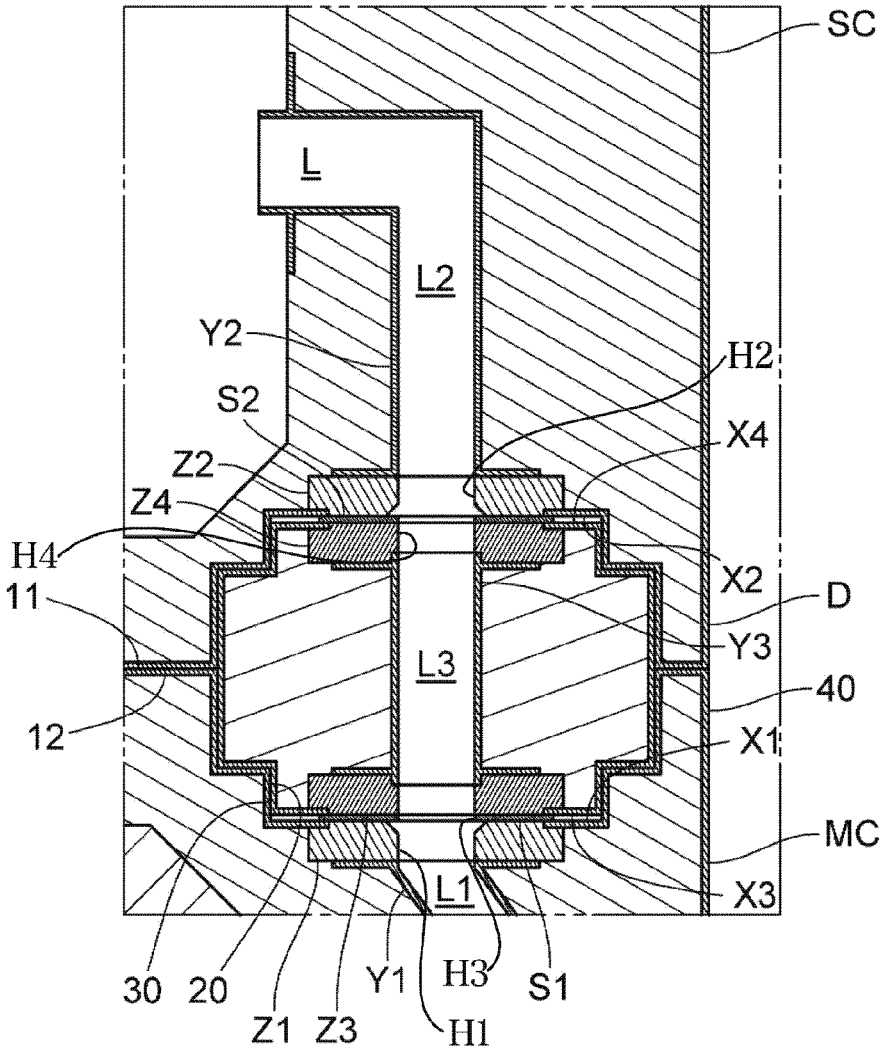
FIG. 6 is a cross-sectional view illustrating an internal configuration of a refrigerator according to an embodiment of the disclosure.

For example, the above embodiment illustrates that the second facing surface X2 and the fourth facing surface X4 of the sub-cabinet SC and the cold air relay duct D, which face each other, are formed as inclined surfaces, referring to in FIGS. 5 and 6, the second facing surface X2 and the fourth facing surface X4 may be formed as horizontal surfaces.

FIG. 5 is a cross-sectional view illustrating an internal configuration of a refrigerator according to an embodiment of the disclosure.

FIG. 6 is a cross-sectional view illustrating an internal configuration of a refrigerator according to an embodiment of the disclosure.

Referring to FIG. 5, it illustrates that the rear surface of the cold air relay duct D constitutes a portion of a rear surface of the refrigerator 100, and referring to FIG. 6, it illustrates that the outer surface of the cold air relay duct D is not exposed.

Figure 7:
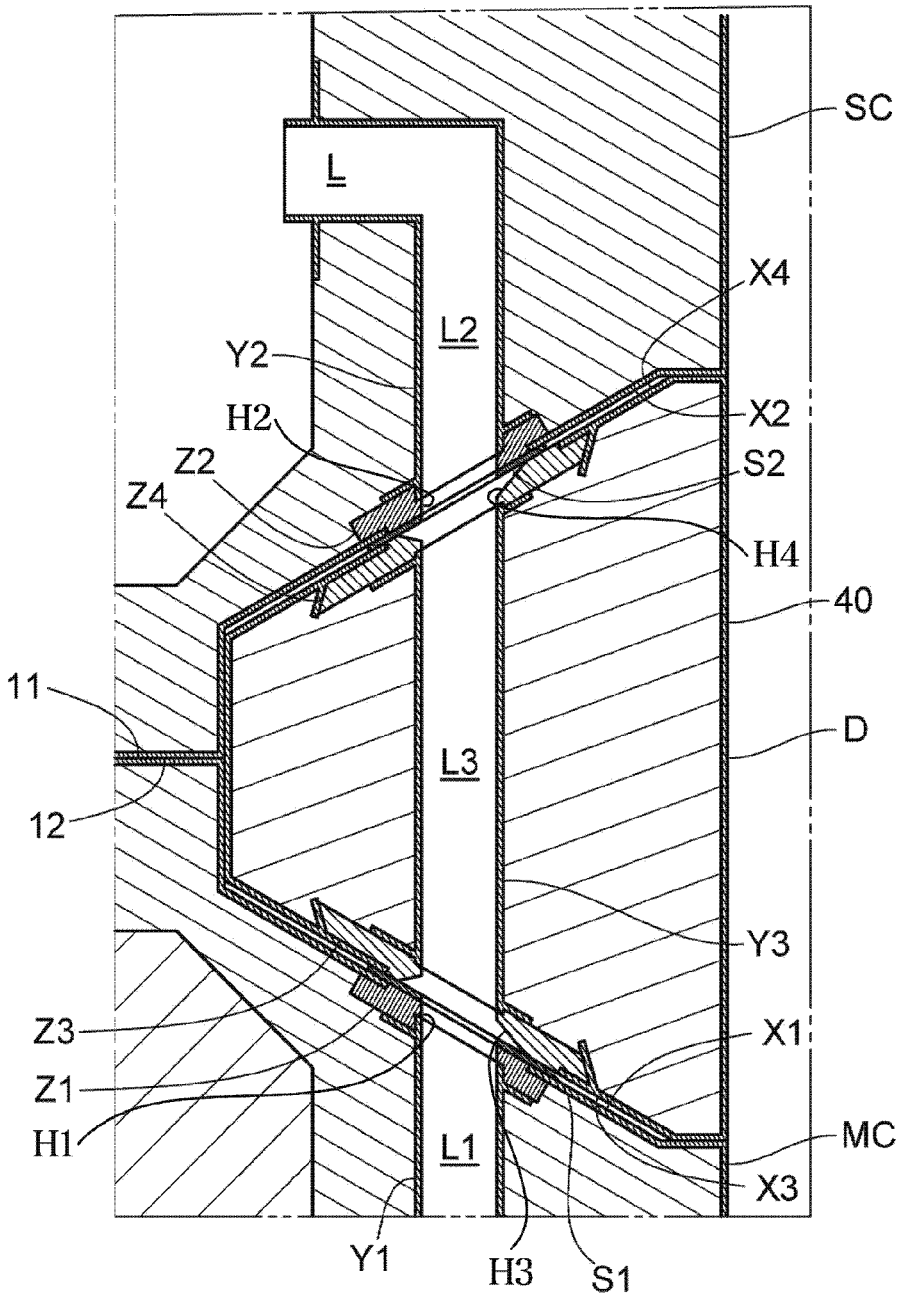
FIG. 7 is a cross-sectional view illustrating an internal configuration of a refrigerator according to an embodiment of the disclosure.

FIG. 7 is a cross-sectional view illustrating an internal configuration of a refrigerator according to an embodiment of the disclosure.

Referring to FIG. 7, the first facing surface X1 and the third facing surface X3 of the main cabinet MC and the cold air relay duct D, which face each other, may be formed as inclined surfaces inclined with respect to the horizontal direction.

When configured as above, the cold air relay duct D may be installed from the rear after the main cabinet MC and the sub-cabinet SC are assembled.

In the connection portion between the main flow path L1 and the relay flow path L3, the flow path width of the main flow path L1 at the end of the first facing surface X1 side is formed wide, but in this connection portion, the flow path width of the relay flow path L3 at the end of the third facing surface X3 side may be formed wide. Also, in the connection portion between the sub flow path L2 and the relay flow path L3, the flow path width of the relay flow path L3 at the end of the fourth facing surface X4 side is formed wide, but in this connection portion, the flow path width of the sub flow path L2 at the end of the second facing surface X2 side may be formed wide.

The above embodiment illustrates that the rear surface 40 of the cold air relay duct D constitutes a portion of the rear surface of the refrigerator 100, but the cold air relay duct D may be arranged such that the surface of the cold air relay duct D is not exposed.

In addition, the refrigerator 100 according to the disclosure may include a plurality of the sub-cabinets SC or a plurality of the main cabinets MC.

As is apparent from the above, according to the embodiments of the disclosure, in a refrigerator in which a plurality of cabinets is detachably configured, cold air can be delivered from a main cabinet to a sub-cabinet through a cold air relay duct while the occurrence of dew condensation can be suppressed.

In the above description of the refrigerator with reference to the accompanying drawings, a specific shape and direction have been mainly described, but it should be interpreted that various modifications and changes are possible by those skilled in the art and such modifications and changes are included in the scope of the disclosure.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A refrigerator comprising:

a main cabinet comprising a cooling device configured to generate cold air;

a sub-cabinet detachably connected to the main cabinet;

a cold air relay duct having a cold air flow path that connects the main cabinet to the sub-cabinet to allow the cold air generated by the cooling device to be delivered to the sub-cabinet; and a heat blocker provided in a portion of the cold air flow path at which the main cabinet and the cold air relay duct are connected and in a portion of the cold air flow path at which the sub-cabinet and the cold air relay duct are connected, wherein the cold air flow path is formed by an inner space of a cylindrical member formed of a resin material, and wherein the cylindrical member comprises:

a first cylindrical member forming a main flow path, a second cylindrical member forming a sub flow path, and a third cylindrical member forming a relay flow path.

2. The refrigerator according to claim 1, wherein the cold air flow path comprises:

the main flow path formed in the main cabinet;

the sub flow path formed in the sub-cabinet; and the relay flow path formed in the cold air relay duct to connect the main flow path and the sub flow path.

3. The refrigerator according to claim 2, wherein the heat blocker is provided at a connection portion between the main flow path and the relay flow path and at a connection portion between the sub flow path and the relay flow path.

4. The refrigerator according to claim 3, wherein the main cabinet comprises a first facing surface facing the cold air relay duct, wherein the sub-cabinet comprises a second facing surface facing the cold air relay duct, and wherein the cold air relay duct comprises a third facing surface facing the main cabinet and a fourth facing surface facing the sub-cabinet.

5. The refrigerator according to claim 4, wherein the heat blocker comprises:

a first heat blocker provided between the main flow path and the first facing surface;

a second heat blocker provided between the sub flow path and the second facing surface;

a third heat blocker provided between the relay flow path and the third facing surface; and a fourth heat blocker provided between the relay flow path and the fourth facing surface.

6. The refrigerator according to claim 5, wherein the first heat blocker comprises a first passing hole, and wherein the third heat blocker comprises a third passing hole to connect the main flow path and the relay flow path, respectively.

7. The refrigerator according to claim 6, wherein at least one of the first passing hole and the third passing hole is formed in a tapered shape in which a width at ends connected to each other gradually increases.

8. The refrigerator according to claim 5, wherein the second heat blocker comprises a second passing hole, and wherein the fourth heat blocker comprises a fourth passing hole to connect the sub flow path and the relay flow path, respectively.

9. The refrigerator according to claim 8, wherein at least one of the second passing hole and the fourth passing hole is formed in a tapered shape in which a width at ends connected to each other gradually increases.

10. The refrigerator according to claim 4, wherein the second facing surface of the sub-cabinet and the fourth facing surface of the cold air relay duct facing the second facing surface have an inclined surface inclined with respect to a horizontal direction.

11. The refrigerator according to claim 10, wherein the cold air relay duct comprises a protrusion formed on the third facing surface to protrude downward, and wherein the main cabinet comprises a recess portion formed on the first facing surface to allow the protrusion to be inserted.

12. The refrigerator according to claim 10, wherein the inclined surface is provided to have an angle between 25 and 65 degrees with respect to the horizontal direction.

13. The refrigerator according to claim 4, wherein the first facing surface of the main cabinet and the third facing surface of the cold air relay duct facing the first facing surface have a first inclined surface inclined with respect to a horizontal direction, and wherein the second facing surface of the sub-cabinet and the fourth facing surface of the cold air relay duct facing the second facing surface have a second inclined surface inclined with respect to the horizontal direction.

14. The refrigerator according to claim 4, wherein a first sealer is provided between the first facing surface of the main cabinet and the third facing surface of the cold air relay duct, and wherein a second sealer is provided between the second facing surface of the sub-cabinet and the fourth facing surface of the cold air relay duct.

15. The refrigerator according to claim 1, wherein the heat blocker has a lower thermal conductivity than a thermal conductivity of the cylindrical member.

16. The refrigerator according to claim 1, wherein the cold air relay duct connects the main cabinet and the sub-cabinet such that at least a portion of a surface thereof is exposed to the outside.

* * * * *